US010702025B1

(12) United States Patent
Paik et al.

(10) Patent No.: US 10,702,025 B1
(45) Date of Patent: Jul. 7, 2020

(54) BUCKLE

(71) Applicant: WOOJIN PLASTIC Co., Ltd., Namyangju-si, Gyeonggi-do (KR)

(72) Inventors: Ji Sook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Namyangju-si, Gyeonggi-Do (KR)

( * ) Notice: Subject to any disclaimer, the term of this patent is extended or adjusted under 35 U.S.C. 154(b) by 0 days.

(21) Appl. No.: 16/810,274

(22) Filed: Mar. 5, 2020

(30) Foreign Application Priority Data

Nov. 26, 2019 (KR) ..... 10-2019-0153382

(51) Int. Cl.
*A44B 11/25* (2006.01)
*A44C 5/20* (2006.01)

(52) U.S. Cl.
CPC ..... *A44B 11/2596* (2013.01); *A44C 5/2066* (2013.01)

(58) Field of Classification Search
CPC ..... A44B 11/2596; A44B 11/2584
See application file for complete search history.

(56) References Cited

U.S. PATENT DOCUMENTS 10,316,887 B2 6/2019 Iannello et al.
10,334,911 B2 * 7/2019 Sixt ..... A41F 1/00
2018/0310673 A1 * 11/2018 Masserini ..... A44B 11/2596

* cited by examiner

*Primary Examiner* — Robert Sandy
(74) *Attorney, Agent, or Firm* — Paratus Law Group, PLLC

(57) ABSTRACT

Disclosed is a buckle including a first connector member provided with a plurality of connecting grooves, and a second connector member provided with a plurality of connecting hooks protruding from the second connector member. While the first connector member and the second connector member are slid in a lateral direction by a first locking protrusion formed on one end portion of the first connector member and a second locking protrusion provided at a center portion of the second connector member, the first and second connector members are connected or disconnected, thereby quickly and readily connecting and disconnecting the buckle within a short stroke distance only by manipulation.

15 Claims, 15 Drawing Sheets

BUCKLE

CROSS-REFERENCE TO RELATED APPLICATION

This application claims priority to Korean Patent Application No. 10-2019-0153382, filed on Nov. 26, 2019, which is hereby incorporated by reference in its entirety.

BACKGROUND

The present invention relates to a buckle of a two-piece type, and more particularly, to a buckle including two releasably connectable members which are attached to each end portion of a belt or strap of various products, such as clothing, bags or backpacks, that can be applied to wide belts or straps with a simple configuration, and can be readily and quickly connected to or disconnected from each other.

In general, a buckle is a fastener including two male and female members which are formed of a plastic material and are releasably engaged to each other by a resilient force. Accordingly, such a buckle is applied to various applications because of light weight and easy fastening ability.

FIG. 1 is a perspective view illustrating one example of a general buckle according to the related art. The buckle includes a plug member 10 and a socket member 20 which are attached to each end portion of straps S1 and S2.

As illustrating in FIG. 1, the plug member 10 has a pair of resilient lock arms 12 linearly protruding from a base 11, and a guide rod 13 linearly extending from the base 11 between the lock arms 12. The socket member 20 has a chamber 21 opened at a front end thereof, and a pair of openings 22 each formed at both sides of the socket member 20. The lock arms 12 of the plug member 10 are inserted and resiliently engaged to the chamber 21 of the socket member 20.

Accordingly, the buckle is fastened by inserting the plug member 10 into the chamber 21 of the socket member 20, by which the pair of lock arms 12 are inserted into the chamber 21 of the socket member 20, and then are resiliently locked to the openings 22. The buckle is released by pressing the lock arms 12, which are inserted into the socket member 20, from both external sides of the openings 22, and pulling the plug member 10 toward the outside.

However, the buckle of the related art is usually applied to the product having the straps S1 and S2 of a relatively narrow width. If the buckle is applied to a wide strap for a life jacket or a hunting vest, there is a drawback in that the whole volume becomes large.

The buckle of the related art is fastened by inserting the plug member 10 into the socket member 20 while holding the members 10 and 20 with both hands. Also, the plug member 10 is disengaged from the socket member 20 by pressing the lock arms 12 of the plug member 10 while holding the members 10 and 20 with both hands. The buckle of the related art is unfastened only by accurate manipulation with both hands. In the case of quickly disconnecting the plug member and the socket member, for example, in the case where a user wearing a life jacket or a bulletproof vest cannot use both hands in an emergency or by injury, or should quickly remove the jacket or vest, it is hard to apply the buckle of the related art.

In order to solve the above problem, U.S. Pat. No. 10,316,887 issued on Jun. 11, 2019 discloses a locking connector assembly including a female connector having a longitudinal passage and a male connector slidably engaged to the longitudinal passage. The male connector and the female connector are disconnected by pulling a central tab, so that a strap connecting portion of a wide width is secured, and the quick disconnection is realized by use of only one hand. However, the above patent has a problem in that since the male connector and the female connector are slidably connected to each other or disconnected from each other in a longitudinal direction thereby to extend a stroke distance, it is inconvenient to manipulate the two connectors in the longitudinal direction. Also, since the male connector should be forcibly pushed in an accurate way from a lateral side of the female connector, it is required for accurate and skilled manipulation. In addition, since the male and female connectors have a circular cross section, there is inconvenient sense of contact when it is applied to the clothing, such as a life jacket.

It is required for a buckle that can be easily and quickly connected or disconnected to provide convenience.

SUMMARY

Therefore, one object of the invention is to provide a buckle that can be applied to a wide strap, or can be applied to a plurality of straps in a widthwise direction.

Another object of the invention is to provide a buckle that is configured to be easily connected.

A further object of the invention is to provide a buckle that can be readily and quickly disconnected by one hand.

A buckle according to an embodiment of the present invention includes: a first connector member including a first base, a first plate extending forward from the first base, a plurality of connecting grooves formed on the first plate, a locking portion formed at one side of the connecting groove, and a first channel formed at a rear portion of the first base to couple a first strap; a second connector member including a second base, a second plate extending forward from the second base, a plurality of connecting hooks protruding from the second plate to be inserted into the corresponding connecting groove and be movable in a lateral direction in an insertion state, with a front end of the respective connecting hooks being provided with a locking shoulder, and a second channel formed at a rear portion of the second base to couple a second strap; and a fastening member including a first locking protrusion protruding from one end portion of the first connector member which faces a corresponding surface of the second connector member, and a second locking protrusion protruding from a resilient piece provided at a center portion of the second connector member which corresponds to the first locking protrusion, in which the first locking protrusion and the second locking protrusion are engaged when the first connector member and the second connector member are laterally moved in an opposite direction, and are disengaged by operation of the resilient piece, wherein the buckle is connected or disconnected by moving the first connector member and the second connector member in a lateral direction in a contact state.

The respective connecting groove may be formed in such a way that one side serves as an entry portion for the connecting hook, and the other side is tapered by the locking portion, and when the connecting hook is moved from the entry portion to the locking portion, the locking shoulder of the connecting hook comes in a lower portion of the locking portion in a contact state.

One side of the connecting groove, in which the connecting hook comes, may be provided with an inclined ramp surface which is inclined toward the locking portion.

One side of the respective connecting hooks which comes into contact with the inclined ramp surface may be inclined in the same direction as a slope of the inclined ramp surface.

A bottom surface of the locking portion may be formed as a slope, and the locking shoulder may be formed as a slope to come into surface contact with the slope of the locking portion.

The first base and the second base may provide a stepped portion with respect to the first plate and the second plate, respectively, and when the first plate comes into contact with the second plate, the front end of the first plate may be guided by the second base in a contact state, while the front end of the second plate may be guided by the first base in a contact state.

The first locking protrusion and the second locking protrusion may have an inclined surface facing a coupling direction thereof, and a vertical surface opposite to the inclined surface, so that the first locking protrusion and the second locking protrusion are smoothly engaged with each other at engagement, while the first locking protrusion and the second locking protrusion are disengaged by lifting the resilient piece at release.

The first locking protrusion and the second locking protrusion may be positioned at the center portions of the first and second connector members, respectively, and the connecting groove and the connecting hook may be positioned at both sides of the first and second locking protrusions.

The first locking protrusion and the second locking protrusion may be positioned at the center portions of the first and second connector members, respectively, and one connecting groove and one connecting hook may be positioned at both sides of the first and second locking protrusions.

Among the connecting grooves of the first connector member, the connecting groove positioned in an entry direction of the second connector member may be opened to expose the locking portion.

With the above configuration of the invention, the first connector member is connected to the second connector member by overlap, and the first and second connector members are attached to the straps along the whole length of the members, so that the buckle can be usefully applied to a product employing a wide strap.

Also, the first connector member and the second connector member can be quickly and readily connected to or disconnected from each other only by manipulation of a short stroke in the overlapped state. In addition, the first and second connector members can be readily disconnected from each other by only one hand.

In addition, since the first connector member and the second connector member are formed in the shape of a plate which comes into contact with each other, even though it is applied to clothing, such as a life jacket, the members are stably close to the clothing, thereby minimizing inconvenience caused by human contact.

BRIEF DESCRIPTION OF THE DRAWINGS

Reference is now made briefly to the accompanying drawings, in which.

Figure 1:
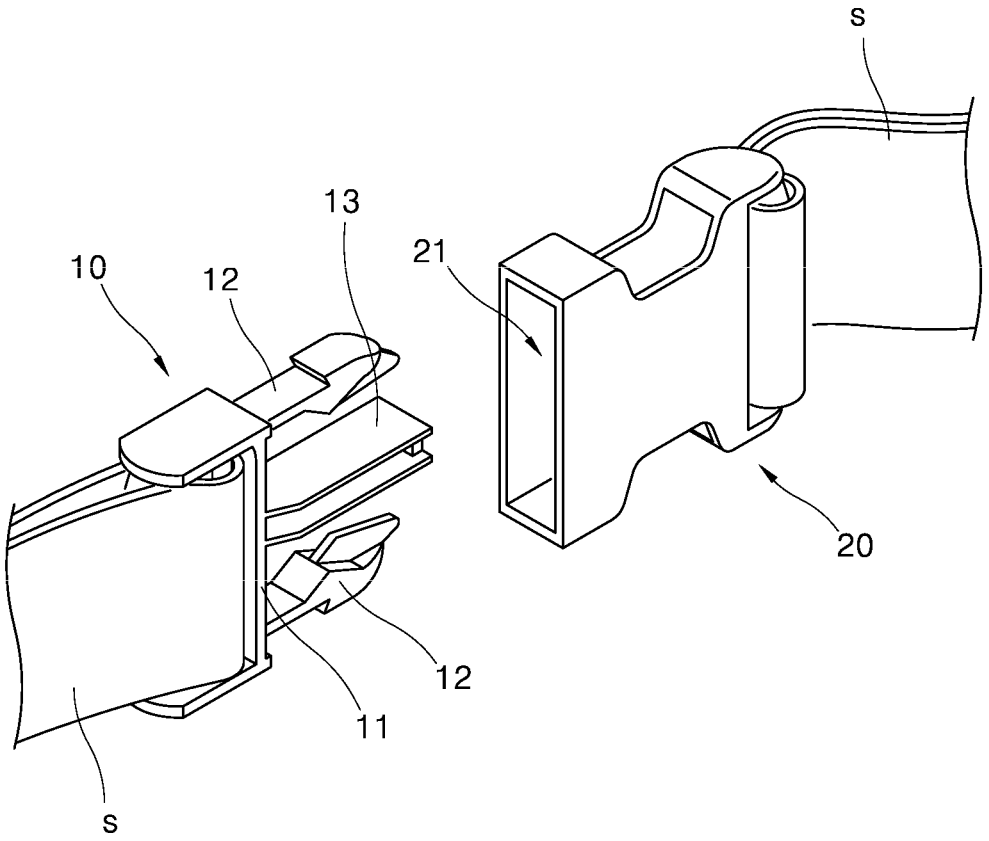
FIG. 1 is a perspective view illustrating one example of a buckle according to the related art.

Repeat use of reference characters throughout the present invention and appended drawings is intended to represent the same or analogous features or elements of the invention.

DETAILED DESCRIPTION

Now, preferred embodiments of the present invention will be described in detail with reference to the accompanying drawings. in the following description, some terminologies used herein are for the purpose of describing particular embodiments only and are not intended to limit the right scope of the invention, in which a thickness of lines or a size of components in the drawings may be illustrated exaggeratedly for the purpose of clearness and convenience. Unless otherwise defined, all terms used herein have the same meaning as commonly understood by one of ordinary skill in the art to which this invention pertains, and should not be interpreted as having an excessively comprehensive meaning nor as having an excessively contracted meaning.

FIGS. 2 to 11 show a buckle according to the first embodiment of the invention.

Figure 2:
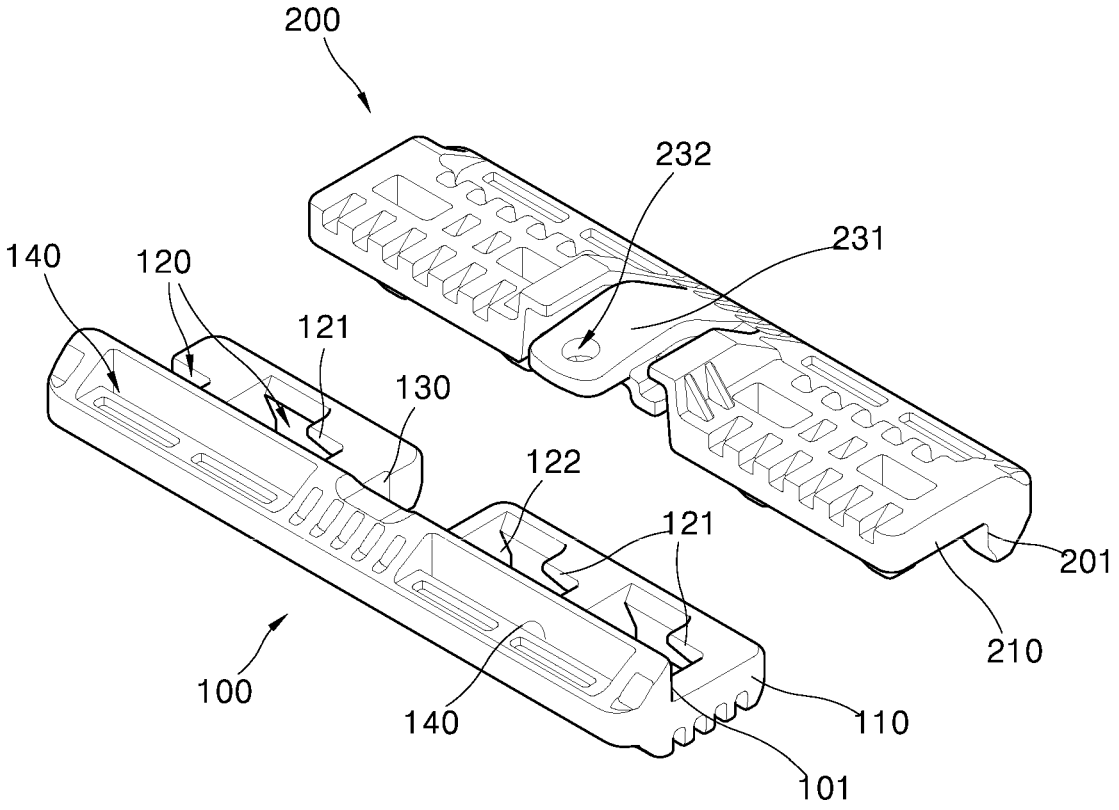
FIG. 2 is an exploded perspective view illustrating a buckle according to one embodiment of the invention.
Figure 3:
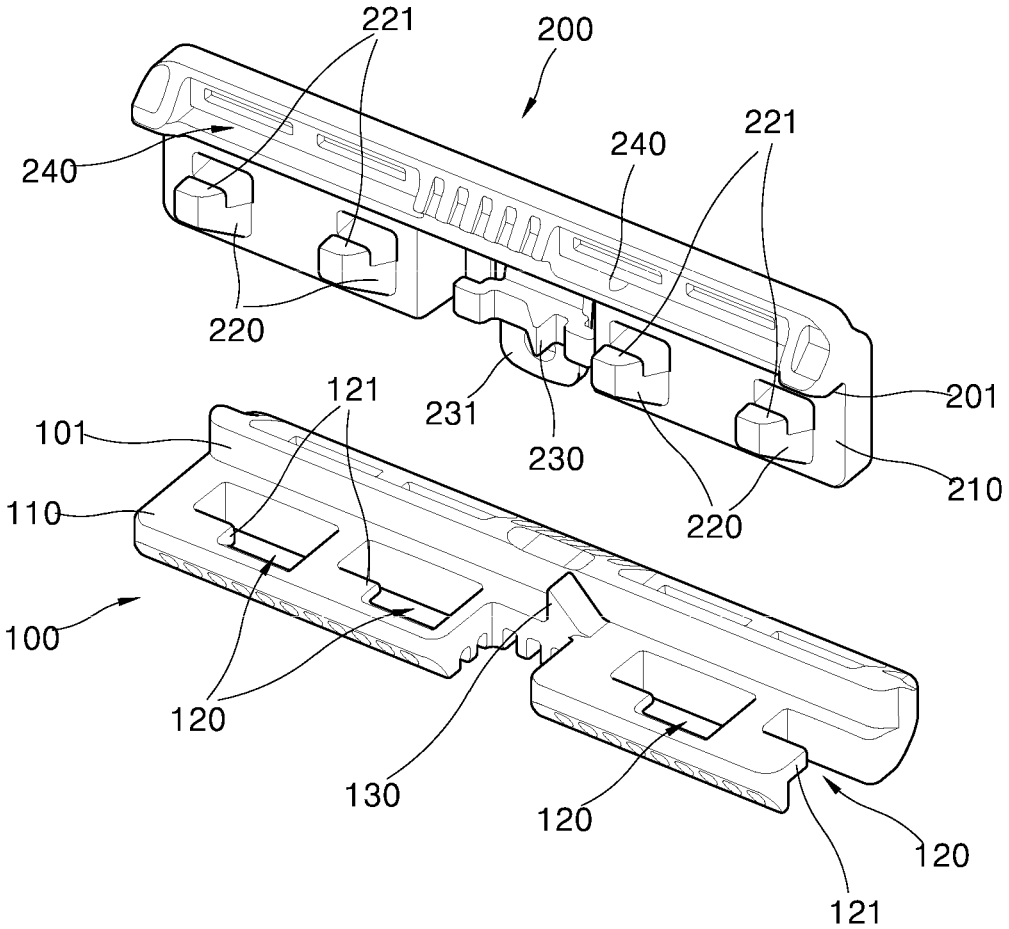
FIG. 3 is an exploded perspective view illustrating the buckle according to the embodiment of the invention when seen at a different angle.
Figure 4A:
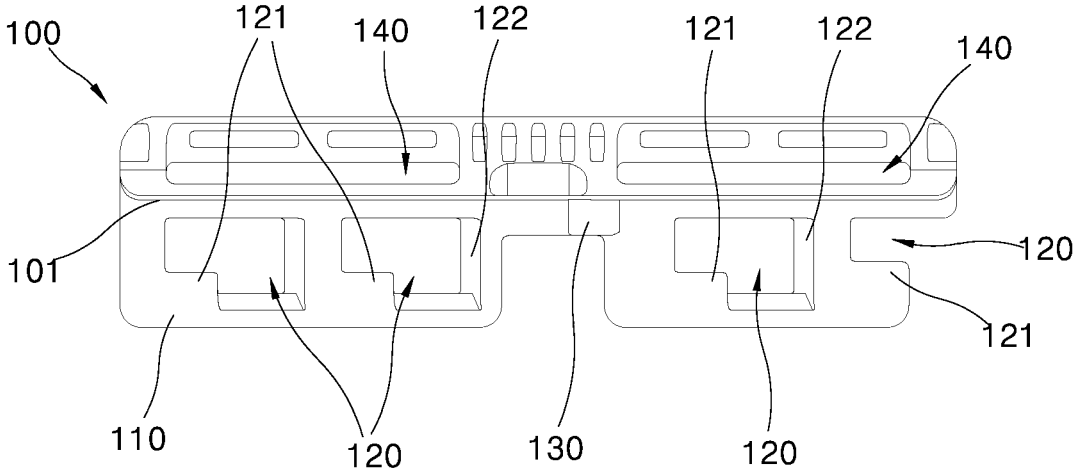
FIGS. 4A to 4C are a plan view, a front view and a right elevational view of a first connector member according to one embodiment of the invention, respectively.
Figure 4B:
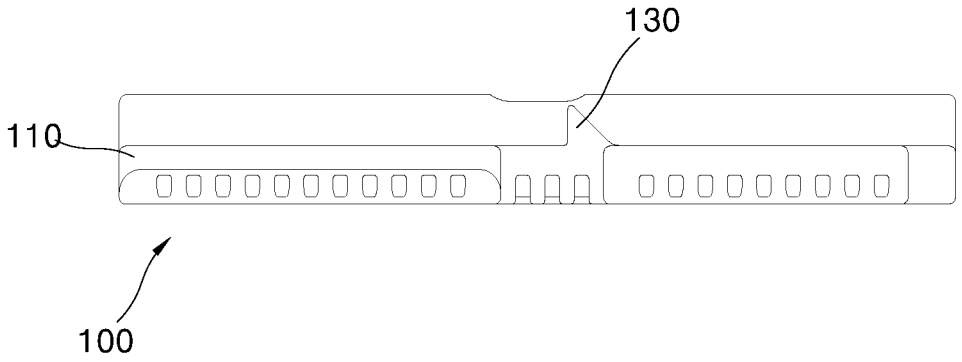
Figure 4C:
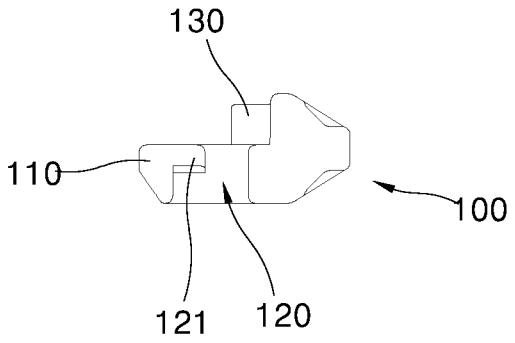
Figure 5A:
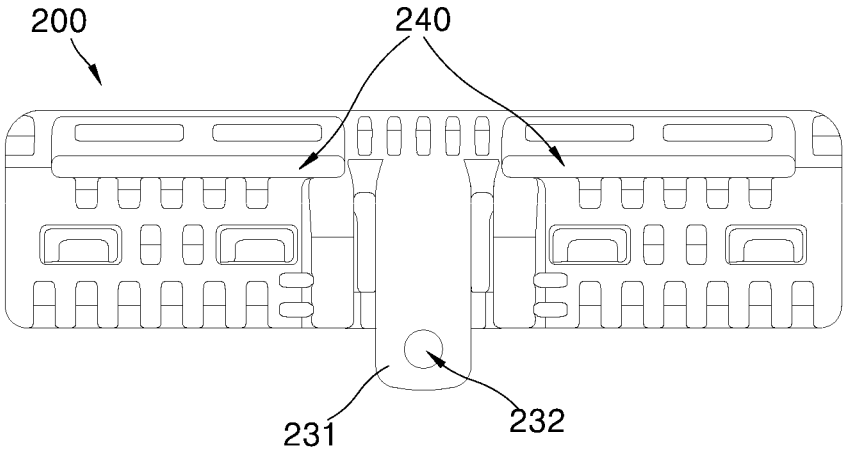
FIGS. 5A to 5C are a plan view, a front view and a right elevational view of a second connector member according to one embodiment of the invention, respectively.
Figure 5B:
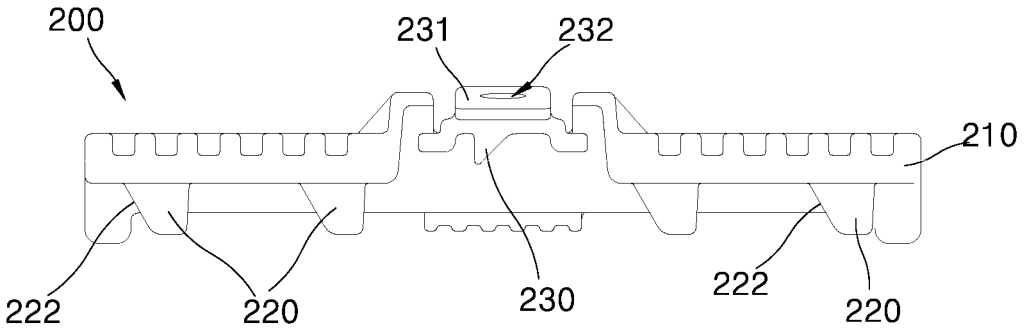
Figure 5C:
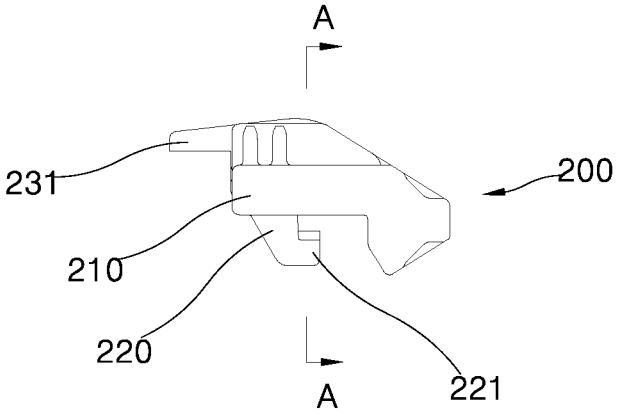
Figure 6:
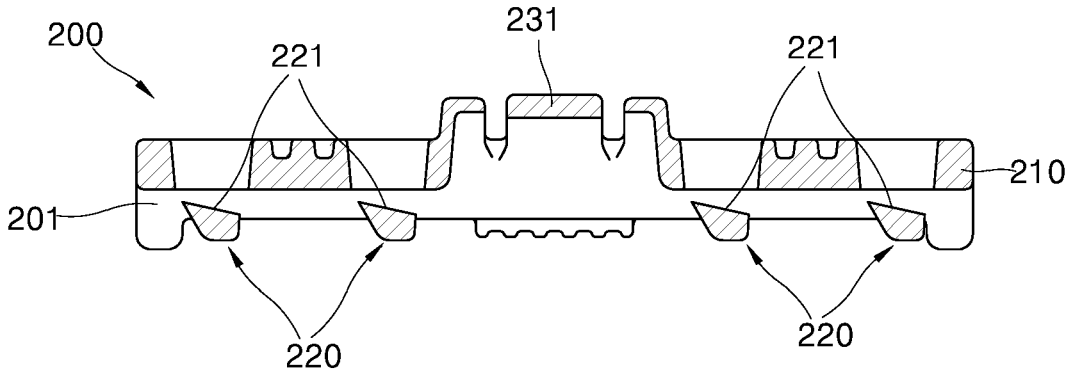
FIG. 6 is a cross-sectional view taken along the line A-A in FIG. 5.

FIG. 2 is an exploded perspective view illustrating the buckle according to one embodiment of the invention. FIG. 3 is an exploded perspective view illustrating the buckle according to the embodiment of the invention when seen at a different angle. FIGS. 4A, 4B and 4C are a plan view, a front view and a right elevational view of a first connector member according to one embodiment of the invention, respectively. FIGS. 5A, 5B and 5C are a plan view, a front view and a right elevational view of a second connector member according to one embodiment of the invention, respectively. FIG. 6 is a cross-sectional view taken along the line A-A in FIG. 5.

Figure 7:
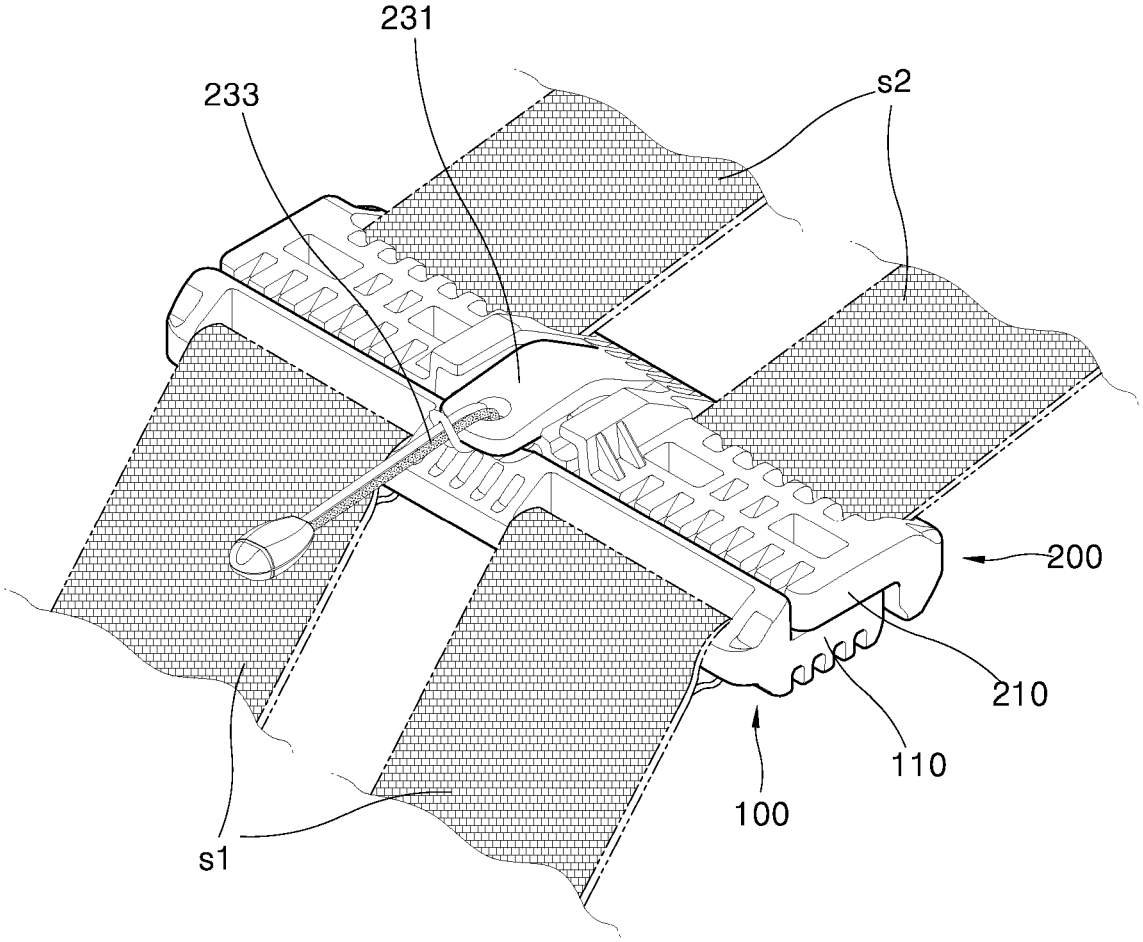
FIG. 7 is a view illustrating an example of a buckle according to the embodiment of the invention which is applied to straps.

Referring to FIGS. 2 to 6, the buckle according to the embodiment of the invention includes a first connector member 100 and a second connector member 200 which are releasably connected to each other, in which the first and second connector members are formed of a synthetic resin, and are coupled to each end portion of straps S1 and S2, as illustrated in FIG. 7.

The first connector member 100 includes a first base 101 extending in a longitudinal direction, a first plate 110 extending forward from the first base 101, a first locking protrusion 130 protruding from a center portion of the first plate 110 and serving as fastening means in cooperation with the second connector member 200, and a plurality of connecting grooves 120 formed at both sides of the first locking protrusion 130.

The connecting grooves 120 are formed in a rectangular shape, and penetrate the first plate. Each of the connecting grooves 120 is provided at one side thereof with a locking portion 121. The locking portion 121 is formed on one corner opposite to a coupling direction of the second connector member 200.

The connecting groove 120 is formed in such a way that one side is wide, while the other side is narrow. The wide side is a space for receiving a connecting hook 220 of the second connector member 200 which will be described later, and the narrow side is a space to which the connecting hook 220 is slid, so that the connecting hook 220 is engaged to the locking portion 121.

The first plate 110 is preferably formed in a plane, and the first base 101 is formed to be perpendicular to a top surface of the first plate 110, or is formed in the shape of a stepped portion relative to the top surface of the first plate. The first base 101 is provided at a rear side thereof with a channel 140 to receive the strap S1.

The second connector member 200 is generally formed in the shape symmetric with respect to the first connector member 100, and includes a second base 201 extending in a longitudinal direction, a second plate 210 extending forward from the second base 201, and a resilient piece 231 disposed in a separated space at a center portion of the second plate 210 and extending from the second base 201.

The resilient piece 231 is provided with a second locking protrusion 230 corresponding to the first locking protrusion 130 of the first connector member 100 and serving as fastening means. An end portion of the resilient piece 231 is provided with a hole 232 for receiving a string or a ring.

The second plate 210 is provided with the plurality of connecting hooks 220 corresponding to the connecting grooves 120, and a front end of the respective connecting hooks 220 is provided with a locking shoulder 221.

The second plate 210 is preferably formed in a plane so as to be close to the first plate 110, and the second base 201 is formed to be perpendicular to a top surface of the second plate 210, or is formed in the shape of a stepped portion relative to the top surface of the second plate. The second base 201 is provided at a rear side thereof with a channel 240 to receive the strap S2.

The first connector member 100 and the second connector member 200 are connected to each other by bringing the first plate 110 and the second plate 210 to touch, inserting the connecting hooks 220 into the connecting grooves 120 and sliding the second connecting hooks 220 in the longitudinal direction.

In the state in which the first connector member 100 and the second connector member 200 are connected to each other, the symmetric L-shaped portions are engaged with each other to improve the contact efficiency with high stability and reduce the whole volume. In the state in which the first plate 110 and the second plate 200 come into contact with each other, the front end of the first plate 110 is slidably guided along the second base 201 of the second connector member 200, and the front end of the second plate 210 is slidably guided along the first base 101 of the first connector member 100, so that the first plate 110 and the second plate 200 are stably slid and engaged to each other.

The locking protrusion 130 and the second locking protrusion 230, which serve as the fastening means, have an inclined surface facing the coupling direction, so that the locking protrusion 130 and the second locking protrusion 230 are smoothly engaged with each other at sliding engagement. Each surface opposite to the inclined surface is formed in the shape of a vertical surface, so that the locking protrusion 130 and the second locking protrusion 230 are limited to move in an opposite direction, without operating the resilient piece 231.

In order to more readily connect the buckle, one side of the connecting groove 120 for receiving the connecting hook 220, i.e., a surface provided with the locking portion 121, is provided with an inclined ramp surface 122 for guiding the connecting hook 220 toward the locking portion 121.

When the connecting hook 220 comes in the connecting groove 120, one end portion of the connecting hook 220 comes into contact with the inclined ramp surface 122, and then is guided toward the locking portion 121.

One side of the connecting hook 220 which comes into contact with the inclined ramp surface 122 is also provided with an inclined contact surface 222 in order to more readily guide the connecting hook 220.

After the connecting hook 220 comes in the connecting groove 120, the first connector member 100 and the second connector member 200 are slid in the longitudinal direction, and then the locking shoulder 221 comes into contact with the bottom surface of the locking portion 121. The bottom surface of the locking portion 121 is formed in the shape of a slope to achieve the smooth connection. The locking shoulder 221 which comes into surface contact with the bottom surface is also formed in the shape of a slope.

Among the connecting grooves 120 of the first connector member 100, the connecting groove positioned at the outside toward an entry direction of the second connector member 200 may be formed opened to expose the locking portion. If the connecting groove positioned at the outside is opened, the connecting hook 220 can further easily come in when the second connector member 200 comes into first contact with the first connector member 100.

Figure 8:
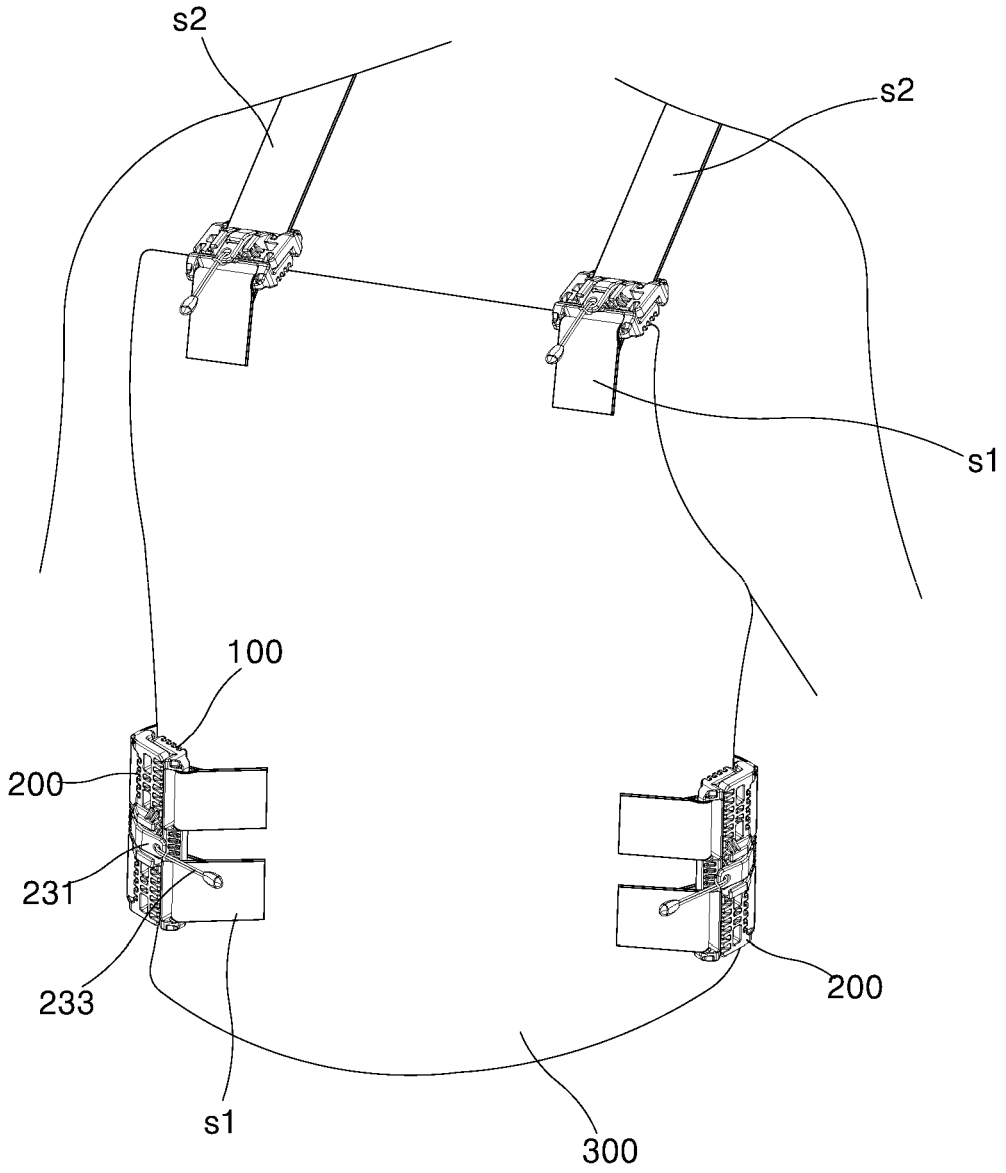
FIG. 8 is a view illustrating an example of a buckle according to the embodiment of the invention which is applied to clothing.

With the above configuration of the buckle according to the embodiment of the invention, as illustrated in FIG. 7, each end portion of the straps S1 and S2 is attached to the respective channels 140 and 240, and a ring or a string 233 is engaged to the hole 232 of the resilient piece 231. As illustrated in FIG. 8, the buckle can be applied to the straps S1 and S2 for a life jacket 300.

The operation of the buckle according to the embodiment of the invention will be described in detail.

Figure 9A:
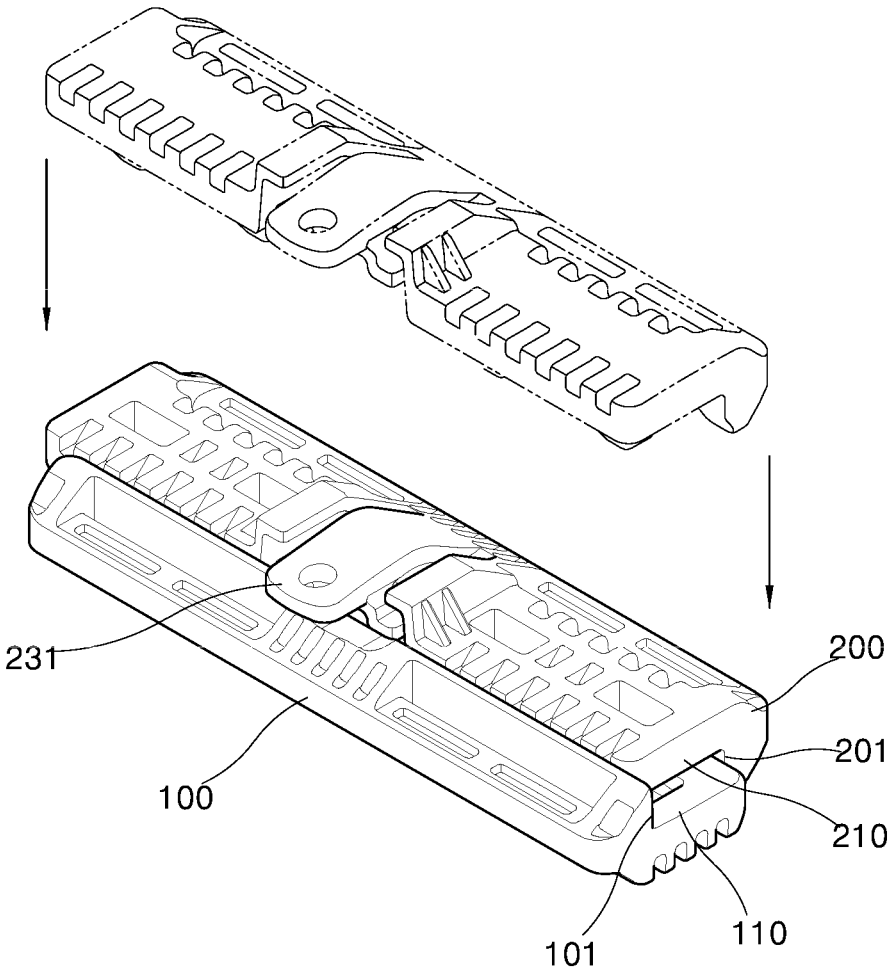
FIGS. 9A to 9F are views illustrating engaged states of the buckle according to the embodiment of the invention.
Figure 9B:
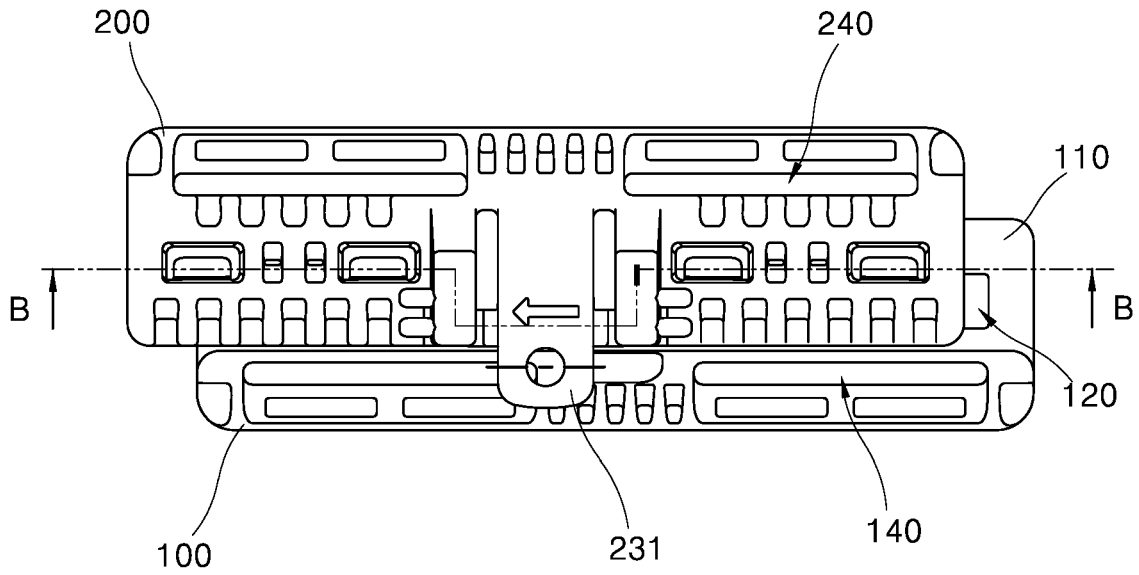
Figure 9C:
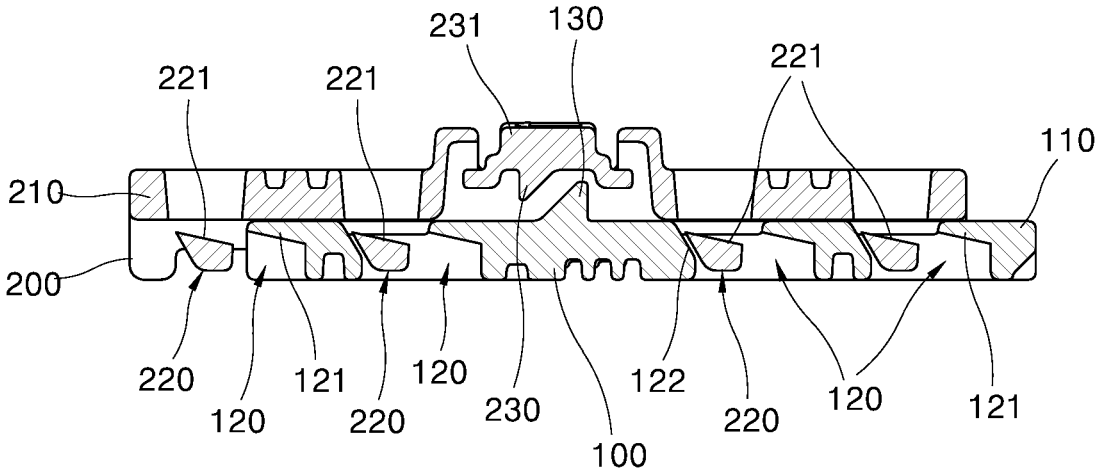
Figure 9D:
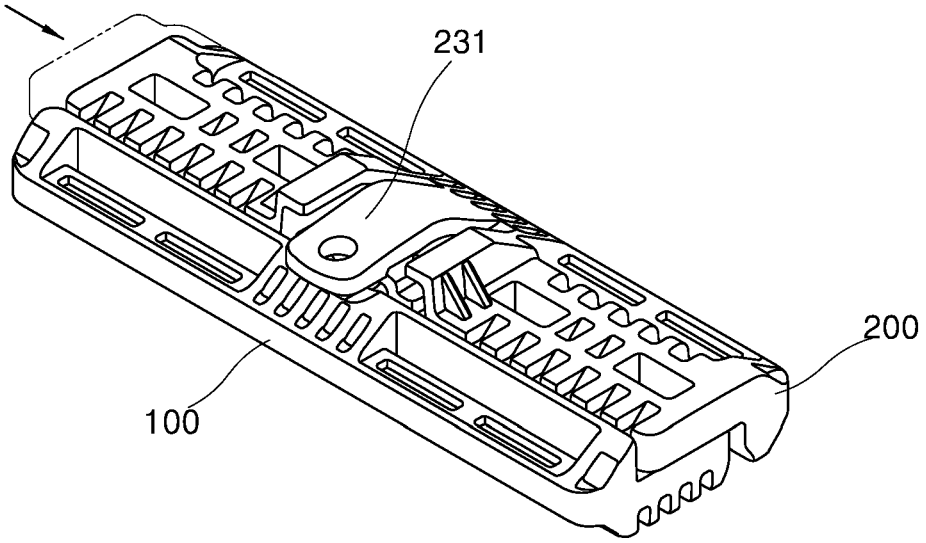
Figure 9E:
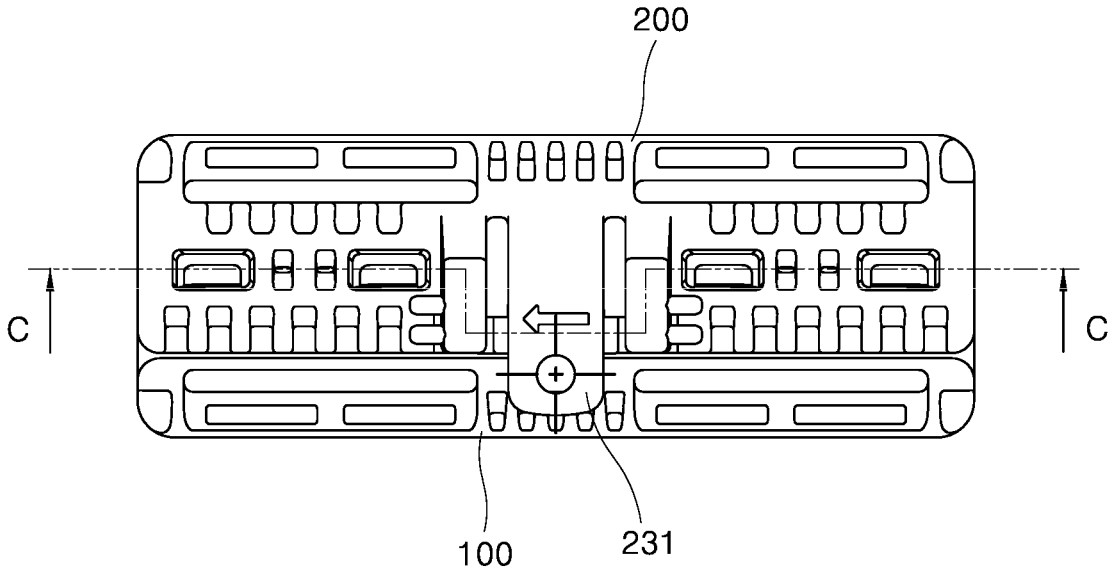
Figure 9F:
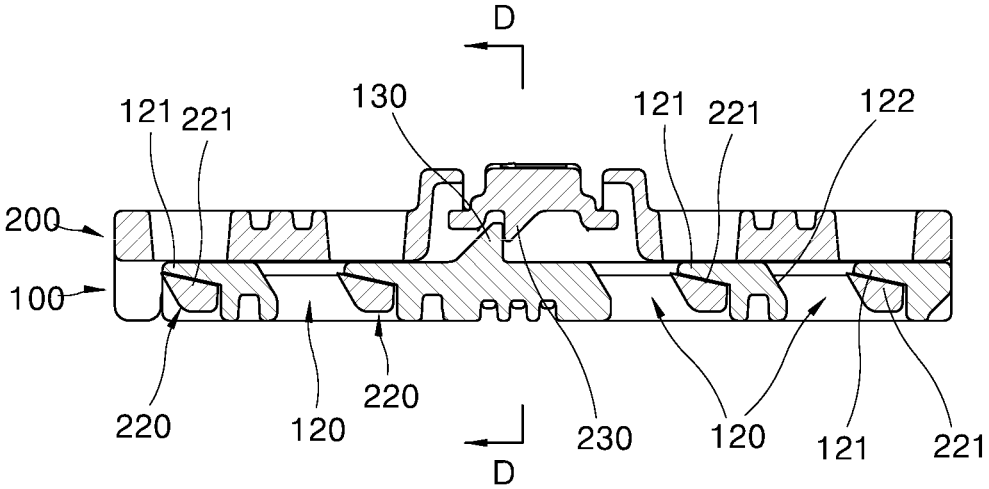

FIGS. 9A to 9F are views illustrating a process of connecting the buckle according to the embodiment of the invention, in which FIG. 9A is a perspective view illustrating an initial contact state in which the first connector member 100 is engaged with the second connector member 200, FIG. 9B is a plan view of FIG. 9A, FIG. 9C is a cross-sectional view taken along the line B-B in FIG. 9B, FIG. 9D is a perspective view illustrating a state in which the connector members are slid and engaged, FIG. 9E is a plan view of FIG. 9D, and FIG. 9F is a cross-sectional view taken along the line C-C in FIG. 9E.

Referring to FIGS. 9A to 9F, in order to connect the first connector member 100 and the second connector member 200, when the second connector member 200 is put on the first connector member 100 at the position illustrated in FIG. 9A, the respective connecting hooks 220 is inserted into the corresponding connecting groove 120, and then the first plate 110 comes into close contact with the second plate 210, while the base 101 of the first connector member 100 is closely abutting against the base 201 of the second connector member 200.

In this instance, the first connector member 100 is slightly out of line with the second connector member 200, as illustrated in FIG. 9B. Also, as illustrated in FIG. 9C, the respective connecting hooks 220 comes in the corresponding connecting groove 120, and the slope of the first locking protrusion 130 faces the slope of the second locking protrusion 230.

The connecting hook 220 is quickly and readily guided by the inclined ramp surface 122 of the connecting groove 120 and the inclined contact surface 222 of the connecting hook 220.

In this instance, if the second connector member 200 is pushed in the longitudinal direction, as illustrated in FIG. 9D, the first connector member 100 is completely overlapped with the second connector member 200, as illustrated in FIGS. 9E and 9F. If the locking shoulder 221 of the respective connecting hooks 220 is slid along the bottom surface of the locking portion 121, and then comes into contact with the bottom surface, thereby preventing the connecting hook 220 from releasing upwardly. Simultaneously, the second locking protrusion 230 rides over the first locking protrusion 130 by the resilience of the resilient piece 231, and then the vertical surface of the second locking protrusion 230 comes into contact with the vertical surface of the first locking protrusion 130, thereby preventing the first and second protrusions from being moved in an opposite direction.

When the first connector member 100 and the second connector member 200 are pushed and engaged with each other in the longitudinal direction, each of the bases 101 and 201 serves as a guide rail for supporting the front end of the respective plates 110 and 210, so that the first connector member 100 and the second connector member 200 can be stably moved.

The bottom surface of the locking portion 121 and the slope of the locking shoulder 221 guide the smooth connection thereof.

With the above connection, the first connector member 100 and the second connector member 200 are not disconnected from each other by the lateral moving restriction of the first locking protrusion 130 and the second locking protrusion 230, and the vertical moving restriction caused by the engagement between the connecting hook 220 and the locking portion 121.

Figure 10A:
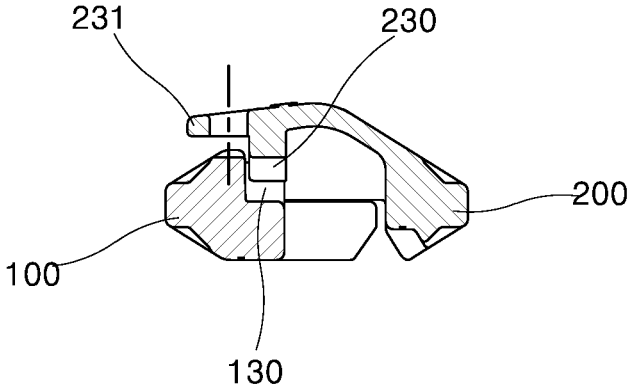
FIGS. 10A and 10B are cross-sectional views illustrating operation of a resilient piece to release the buckle.
Figure 10B:
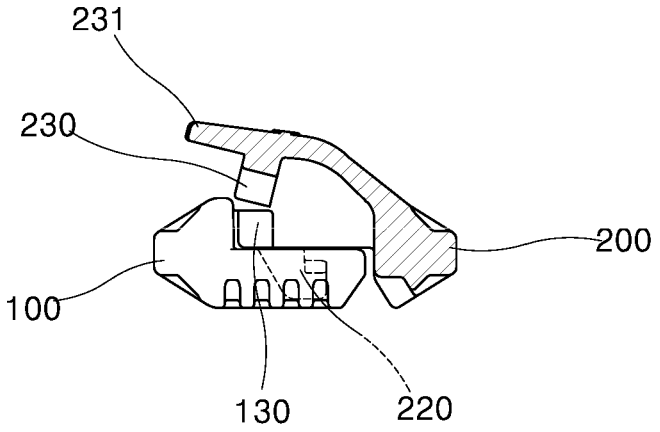

FIG. 10A is a cross-sectional view of FIG. 9F. When the resilient piece 231 is lifted, as illustrated in FIG. 10B, in the state in which the first connector member 100 is engaged with the second connector member 200, the second locking protrusion 230 formed integrally with the resilient piece 231 is also lifted, thereby releasing the contact state between the first locking protrusion 130 and the second locking protrusion 230. In this instance, if the first connector member 100 and the second connector member 200 are slid in a direction opposite to the coupling direction, the locking shoulder 221 of the connecting hook 220 is disconnected from the locking portion 121, so that the connecting hook 220 is released from the connecting groove 120.

Figure 11:
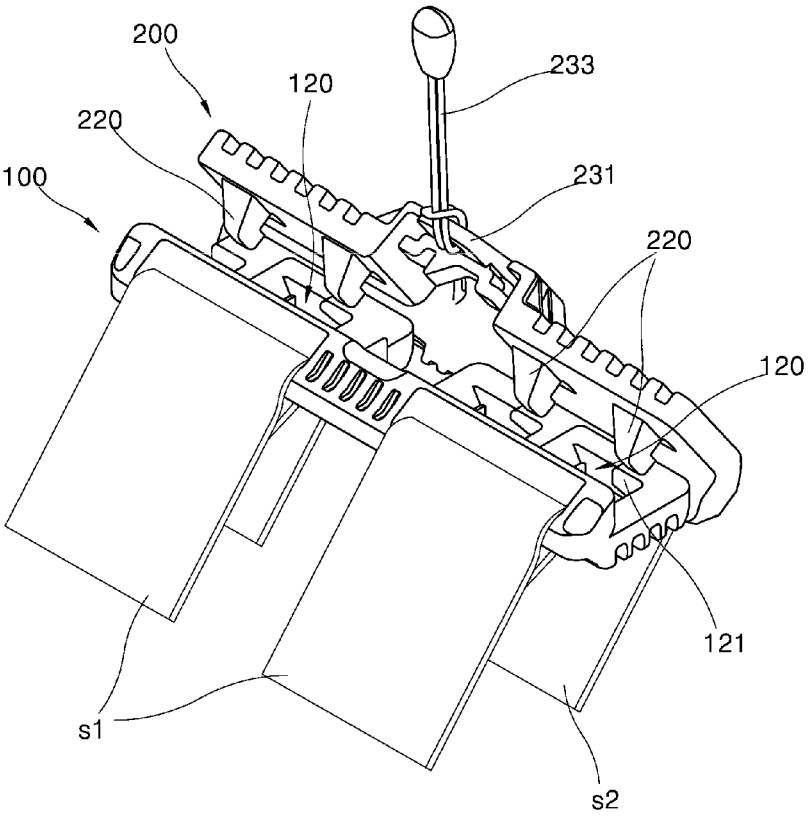
FIG. 11 is a perspective view illustrating the state of the buckle in FIG. 10B.

FIG. 11 shows the disconnecting state of the buckle according to the embodiment of the invention in three dimensions. When the first connector member 100 and the second connector member 200 are disconnected, the resilient piece 231 is lifted by pulling a string 233 coupled to the hole 232 of the resilient piece, and simultaneously, the first locking protrusion 130 and the second locking protrusion 230 are disconnected by pulling the resilient piece 231 in a lateral direction. While the second connector member 200 is sliding in the lateral direction, the connecting hook 220 is quickly released from the connecting groove 120, thereby quickly disconnecting the first connector member 100 and the second connector member 200.

The buckle according to the invention can be quickly and readily connected or disconnected within a short stroke distance of the connecting groove 120, and the connection and disconnection can be easily carried out by one hand.

Figure 12:
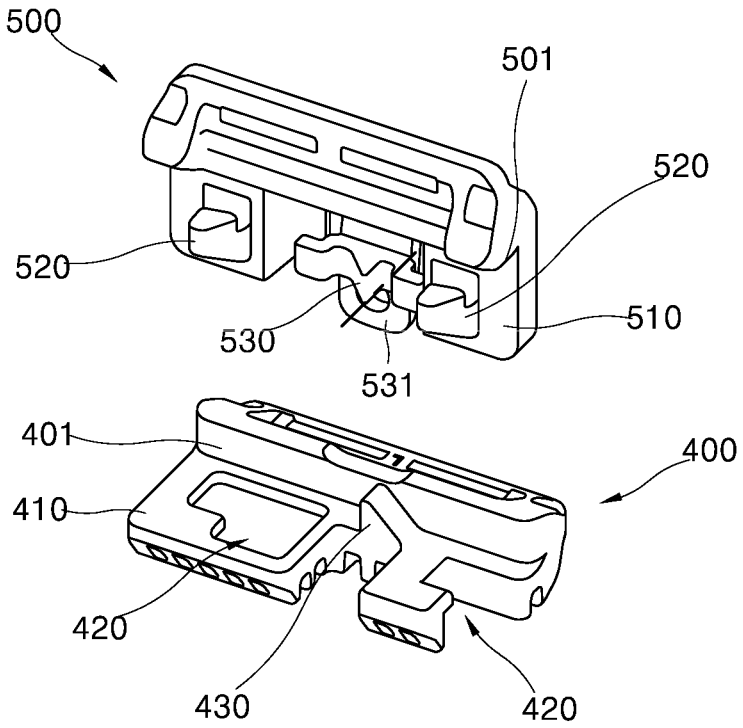
FIG. 12 is an exploded perspective view illustrating a buckle according to another embodiment of the invention.
Figure 13:
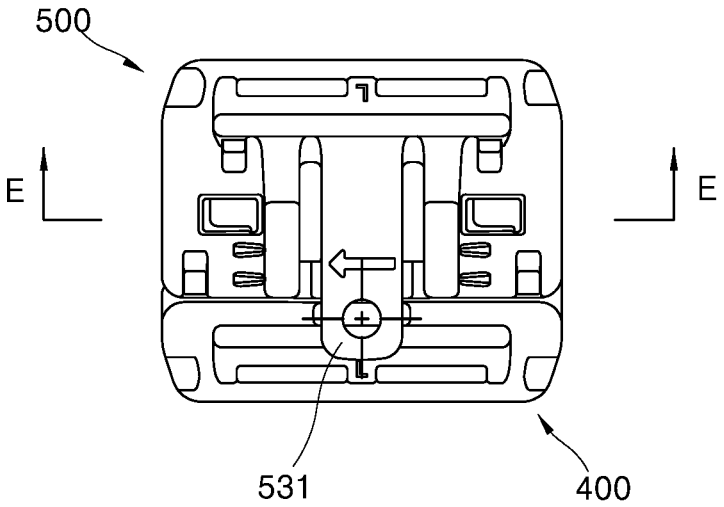
FIG. 13 is a plan view illustrating the engaged state of the buckle in FIG. 12.
Figure 14:
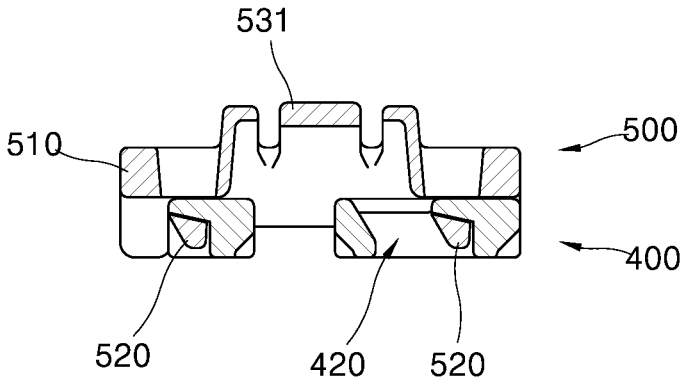
FIG. 14 is a cross-sectional view taken along the line E-E in FIG. 13.

FIGS. 12 to 14 show a buckle according to another embodiment of the invention, in which the same components as those in the above embodiment will not be described herein.

FIG. 12 is an exploded perspective view illustrating the buckle according to another embodiment of the invention. FIG. 13 is a plan view illustrating the engaged state of the buckle in FIG. 12. FIG. 14 is a cross-sectional view taken along the line E-E in FIG. 13. Referring to FIGS. 12 to 14, a first connector member 400 includes a first base 401 extending in a longitudinal direction, a first plate 410 extending forward from the first base 401, a first locking protrusion 430 protruding from a center portion of the first plate 410, and a pair of connecting grooves 420 each formed at both sides of the first locking protrusion 430. A second connector member 500 includes a second base 501 extending in a longitudinal direction, a second plate 510 extending forward from the second base 501, a resilient piece 531 and a second locking protrusion 530 disposed at a center portion of the second plate 510, and a pair of connecting hooks 520 each protruding from both sides of the second locking protrusion 530.

The whole length of the first connector member 400 and the second connector member 500 is relatively short, and the buckle of this embodiment can be properly applied to a strap of narrow width or one strap.

As illustrated in the drawings, among the connecting grooves 420 of the first connector member 400, one connecting groove 420 positioned toward the coupling direction of the second connector member 500 is partially opened to easily perform the connection of the second connector member 500.

The connection and disconnection of the buckle according to this embodiment is substantially identical to that of the buckle according to the first embodiment.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. For example, the shape or coupling state of the connecting groove, the connecting hook, the locking portion or the locking protrusion may be properly modified, if necessary, and various portions may be additionally applied to the respective connector members.

What is claimed is:

1. A buckle comprising:

a first connector member including a first base, a first plate extending forward from the first base, a plurality of connecting grooves formed on the first plate, a locking portion formed at one side of each connecting groove, and a first channel formed at a rear portion of the first base to couple a first strap;

a second connector member including a second base, a second plate extending forward from the second base, a plurality of connecting hooks protruding from the second plate to be inserted into the corresponding connecting grooves of the first connector member and be movable in a lateral direction in an insertion state, with a front end of each respective connecting hook being provided with a locking shoulder, and a second channel formed at a rear portion of the second base to couple a second strap; and a fastening means including a first locking protrusion protruding from one end portion of the first connector member which faces a corresponding surface of the second connector member, and a second locking protrusion protruding from a resilient piece provided at a center portion of the second connector member which corresponds to the first locking protrusion, in which the first locking protrusion and the second locking protrusion are engaged when the first connector member and the second connector member are laterally moved in an opposite direction, and are disengaged by operation of the resilient piece, wherein the buckle is connected or disconnected by moving the first connector member and the second connector member in a lateral direction in a contact state.

2. The buckle according to claim 1, wherein each respective connecting groove is formed in such a way that one side of each connecting groove serves as an entry portion for the respective connecting hook, and another side of each connecting groove is tapered by the locking portion, and when the respective connecting hook is moved from the entry portion to the locking portion, the locking shoulder of the respective connecting hook comes in contact with a lower portion of the locking portion in a contact state.

3. The buckle according to claim 2, wherein one side of each connecting groove, in which the respective connecting hook comes in contact with, is provided with an inclined ramp surface which is inclined toward the locking portion.

4. The buckle according to claim 3, wherein one side of the respective connecting hook which comes into contact with the inclined ramp surface is inclined in the same direction as a slope of the inclined ramp surface.

5. The buckle according to claim 2, wherein a bottom surface of the locking portion is formed as a slope, and the locking shoulder is formed as a slope to come into surface contact with the slope of the locking portion.

6. The buckle according to claim 1, wherein one side of the respective connecting groove, in which the connecting hook comes in contact with, is provided with an inclined ramp surface which is inclined toward the locking portion.

7. The buckle according to claim 6, wherein one side of the respective connecting hook which comes into contact with the inclined ramp surface is inclined in the same direction as a slope of the inclined ramp surface.

8. The buckle according to claim 1, wherein a bottom surface of the locking portion is formed as a slope, and the locking shoulder is formed as a slope to come into surface contact with the slope of the locking portion.

9. The buckle according to claim 1, wherein the first base and the second base provide a stepped portion with respect to the first plate and the second plate, respectively, and when the first plate comes into contact with the second plate, the front end of the first plate is guided by the second base in a contact state, while the front end of the second plate is guided by the first base in a contact state.

10. The buckle according to claim 1, wherein the first locking protrusion and the second locking protrusion have an inclined surface facing a coupling direction thereof, and a vertical surface opposite to the inclined surface, so that the first locking protrusion and the second locking protrusion are smoothly engaged with each other at engagement, while the first locking protrusion and the second locking protrusion are disengaged by lifting the resilient piece at release.

11. The buckle according to claim 1, wherein the first locking protrusion and the second locking protrusion are positioned at the center portions of the first and second connector members, respectively, the plurality of connecting grooves are positioned at both sides of the first locking protrusion, and the plurality of connecting hooks are positioned at both sides of the second locking protrusion.

12. The buckle according to claim 11, wherein among the connecting grooves of the first connector member, the connecting groove positioned in an entry direction of the second connector member is opened to expose the locking portion.

13. The buckle according to claim 1, wherein the first locking protrusion and the second locking protrusion are positioned at the center portions of the first and second connector members, respectively, and one connecting groove and one connecting hook are positioned at both sides of the first and second locking protrusions.

14. The buckle according to claim 13, wherein among the connecting grooves of the first connector member, the connecting groove positioned in an entry direction of the second connector member is opened to expose the locking portion.

15. The buckle according to claim 1, wherein among the connecting grooves of the first connector member, the connecting groove positioned in an entry direction of the second connector member is opened to expose the locking portion.

* * * * *